United States Patent [19]

Gaillard et al.

[11] Patent Number: 5,031,201

[45] Date of Patent: Jul. 9, 1991

[54] ROTATING X-RAY TUBE ANTICATHODE

[75] Inventors: Dominique Gaillard, Paris; Didier Boya, Jonquieres, both of France

[73] Assignee: COMURHEX Societe pour la Conversion de l'Uranium en metal et Hexafluore, Courbevoie, France

[21] Appl. No.: 572,718

[22] Filed: Aug. 24, 1990

[30] Foreign Application Priority Data

Aug. 31, 1989 [FR] France ..... 89 11441

[51] Int. Cl.[5] ..... H01J 35/10

[52] U.S. Cl. ..... 378/144; 378/143

[58] Field of Search ..... 378/144, 143

[56] References Cited

FOREIGN PATENT DOCUMENTS

| | | | |
|---|---|---|---|
| 323366 | 7/1989 | European Pat. Off. . | |
| 3314881 | 10/1984 | Fed. Rep. of Germany . | |
| 60-12653 | 1/1985 | Japan | 378/144 |
| 617554 | 1/1986 | Japan | 378/144 |
| 154648 | 3/1989 | Japan | 378/144 |

OTHER PUBLICATIONS

Patent Abstracts of Japan, vol. 13, No. 173, Apr. 24, 1989.

*Primary Examiner*—Craig E. Church

*Attorney, Agent, or Firm*—Michael N. Meller

[57] ABSTRACT

An X-ray tube anticathode, intended to be used, for example, in medical instruments, such as scanners, includes a support made of a ceramic/ceramic composite material and a refractory metal film directly in contact with this support. The use of a ceramic/ceramic composite makes it possible to rotate the anticathode at an extremely high speed. In addition, this composite is selected 1) so that its coefficient of expansion is as compatible as possible with that of the refractory metal, which favors adhesion between the support and the active film, and 2) so that the phenomenon of the diffusion of carbon atoms is suppressed or minimized at the active film under the effect of the rise of temperature by not using a graphite material, which renders it ineffective in using an anticarbonizing film, such as rhenium, indium, SiC, etc.

5 Claims, No Drawings

ROTATING X-RAY TUBE ANTICATHODE

FIELD OF THE INVENTION

The invention concerns an X-ray tube anticathode designed to be able to rotate at an extremely high speed.

BACKGROUND OF THE INVENTION

X-ray tube anticathodes are rotating disks constituted by a support coated at least partly with an active film made of a refractory metal. They are used in medical instruments, such as scanners.

The current trend of medical instrument manufacturers is to be able to increase the power received by the anticathode and/or to reduce the size of the impact spot of the electron bombardment in such a way as to improve definition of the image obtained. This desire to increase the power or reduce the size of the spot is limited by the slow progress of the anticathode in evacuating the stored heat and consequently by the temperature of the focal track rising to the temperature for melting the material constituting the active film of the anticathode on which this track is formed.

Most frequently, the support of the anticathode is made of a material containing carbon and constituted by a polycrystalline graphite whose coefficient of expansion is compatible with that of the refractory metal, such as tungsten, a tungsten/rhenium alloy or a molybdene-based alloy which is secured (for example, by brazing) or deposited (for example, in a vapor phase or by electrolytic means) onto this support.

So as to keep the temperature of the focal track to acceptable values in a steady or transient state whilst increasing the power or by reducing the size of the spot, one solution would consist of significantly increasing the rotation speed of the anticathodes so as to reach speeds equal to or greater than 20,000 rpm, for example, unfortunately, the polycrystalline graphites normally constituting the support of anticathodes do not possess sufficient mechanical resistance. In fact, they splinter under the effect of centrifugal force before reaching such a speed.

Furthermore, in conventional anticathodes with a graphite support coated with a rhenium/tungsten alloy film, it is essential to insert an extremely fine rhenium sub-film. In fact, from several hundreds of degrees, the carbon atoms of the graphite tend to migrate so as to form with the tungsten a fragile film of tungsten carbide provoking a loss of cohesion between the substrate and the active film and disturbing the thermal transfer. Up to a temperature of about 1200° C., the rhenium prevents this migration and thus plays the role of an anticarbonizing barrier. However, beyond this temperature, the rhenium is increasingly less effective and the anticathode then exceeds its functioning limit. Moreover, the rhenium is an expensive substance and thus increases the cost of the anticathode.

Other less costly materials, such as SiC and TaC, may play the role of an anticarbonizing barrier, but the fact that an additional stage needs to be added to the method results in increasing the overall cost of said method.

The document EP-A-0 236 24A proposes a method to embody an anticathode from a composite support formed of carbon fibers embedded in a carbon matrix ("carbon/carbon" composite). Such a composite material possesses mechanical resistance much greater than the polycrystalline graphites used previously, which makes it possible to rotate the anticathode at an extremely high speed without the disk risking being splintered under the effect of centrifugal force.

Unfortunately, such a composite carbon/carbon material has a coefficient of expansion widely differing from that of the metallic film. Thus, the coefficient of expansion of a carbon/carbon composite is $0.5.10^{-6}$ °K.$^{-1}$ at 25° C. and $2.10^{6}$ °K.$^{-1}$ at 1000° C., whereas the coefficient of expansion of a rhenium/tungsten alloy metal film is $4.10^{-6}$ °K.$^{-1}$ at 25° C. and $4.5.10^{-6}$ °K.$^{-1}$ at 1000° C.

To overcome this drawback, the document EP-A-0 236 241 proposes depositing the metallic film on a graphite substrate with a coefficient of expansion similar to that of the metal, this graphite substrate being associated by any means (brazing, glueing, embedding, etc) with the carbon/carbon composite support.

Thus, an anticathode is embodied having a mechanic resistance enabling it to rotate at a high speed, but the production of the anticathode is complicated by virtue of the incompatibility of firstly the coefficients of expansion of the carbon/carbon composite support and secondly of the metal film/graphite assembly. In addition, the presence of a graphite substrate between the metal film and composite support requires the insertion between the graphite substrate and the metal film an extremely fine sub-coating of rhenium to be used as an anticarbonizing barrier, as in conventional anodes with a graphite support. The use temperature of the anticathode is thus limited and increases its cost.

SUMMARY OF THE INVENTION

The specific object of the present invention is to provide an X-ray tube anticathode designed in such a way as to be able to rotate at extremely high speed without splintering and having a simpler and less costly structure than is the case with existing anticathodes and able to be used at higher powers and power densities.

According to the invention, this result is obtained by means of a rotating X-ray tube anticathode including a support coated at least partly with a refractory metal film and characterized by the fact that the refractory metal film is in direct contact with the support made of a composite material formed of ceramic fibers embedded in a ceramic matrix (ceramic/ceramic composite), this material having a coefficient of expansion adapted to that of the refractory metal.

It can be readily understood that by using a ceramic/ceramic composite material whose coefficient of expansion is compatible with that of the refractory metal, the rotation speed of the anticathode is able to reach and even exceed 20,000 rpm without it being necessary to insert between the support and the refractory metal an intermediate graphite film or, accordingly, an anticarbonizing sub-film. The anticathode may also function at much higher active support/film interface temperatures and thus increase the performances of the X-ray tube. In addition, the suppression of the intermediate graphite film and rhenium sub-film considerably reduces costs.

Advantageously, the support is made of a composite material selected from the group including: SiC matrix/SiC fibers; $Si_3N_4$ matrix/Sic Fibers; Sic matrix/C fibers; $B_4C$ matrix/C fibers; $Si_3N_4$ matrix/C fibers; $B_4C$ matrix/SiC fibers; and Ti $B_2$ matrix/Ti $B_2$ fibers.

From these composite materials, it would be preferable to select a material formed of SiC fibers embedded in a SiC matrix.

Advantageously, the refractory metal is either tungsten or a tungsten/rhenium alloy.

In practice, the ceramic/ceramic composite used conforming to the invention to embody the support of a rotating X-ray tube anticathode includes a fiber armature which may be formed by either a stack of bidimensional fabrics or by a tridimensional fabric. From this armature, the composite is obtained by means of the liquid or gaseous phase impregnation of fibrous fabrics by the material constituting the ceramic matrix of the composite. The density of the fibers in the composite material obtained preferably exceeds 40% and the total porosity rate of this material is less than 20%.

In the case where the ceramic/ceramic composite material is constituted by silicon carbide fibers embedded in a silicon carbide matrix, the coefficient of expansion of this composite is about $3\times10^{-6}$ °K.$^{-1}$ at 25° C. and $4\times10^{-6}$ °K.$^{-1}$ at 1000° C. This coefficient of expansion is to be brought closer to that of the rhenium/tungsten alloy, the coefficient of the latter being about $4\times10^{-6}$ °K.$^{-1}$ at 25° C. and $4.5\times10^{-6}$ °K.$^{-1}$ at 1000° C., as previously mentioned.

Having regard to the fact that these coefficients of expansion of the composite support and metallic alloy are adapted, the active metallic film is placed in accordance with the invention directly in contact with the support of the anticathode.

The linking between the active metal film and the support may be effected in different ways. Thus, the metal film may be rendered integral with the support made of the ceramic/ceramic material by brazing, deposited on this support by melted salt electrolysis, by vapor phase depositing (CVD), by cathode evaporation (PVD), by magnetron atomization, by plasma projection, etc. The metal film may also be rendered integral with the support by bevel shouldering or embedding so that the two materials are imbricated and mechanically rendered integral.

By way of example, when embodying the support of the anticathode, it is possible to select SiC/SiC composites having those characteristics given in table I appearing below:

TABLE I

| | at 23° C. | at 1000° C. | at 1400° C. |
|---|---|---|---|
| density (g.cm$^{-3}$) | 2.7 | 2.7 | 2.7 |
| thermal diffusivity: | | | |
| parallel to the surface | 12 | 5 | 5 |
| perpendicular to surface ($10^{-6}$ m$^2$ s$^{-1}$) | 6 | 2 | 2 |
| coefficient of expansion: | | | |
| parallel to surface | 3 | 4 | |
| perpendicular to surface ($10^{-6}$ · K$^{-1}$) | 2.5 | 2.5 | |
| specific heat Cp (J.Kg$^{-1}$ · K$^{-1}$) | 620 | 1200 | |
| emissivity | 0.75-0.80 | | |
| resistance to traction (MPa) | 200 | 200 | 200 |

As has already been mentioned, the support of the anticathode may also be embodied in other ceramic/ceramic composite materials which are mainly selected so that their coefficient of expansion is as close as possible to the coefficient of expansion of the refractory metal coated for this support. Examples of other composite materials thus able to be used to embody the support of the anticathode are given in table II appearing below:

TABLE II

| Fibers | Matrix |
|---|---|
| SiC | $Si_3N_4$ |
| C | SiC |
| C | $B_4C$ |
| C | $Si_3N_4$ |
| SiC | $B_4C$ |
| $TiB_2$ | $TiB_2$ |

According to the invention, the problems of incompatibility of the coefficients of expansion previously encountered are thus resolved with the use of anticathode supports made of a carbon/carbon composite material. As a result, it is possible to avoid any redhibitory cracks which appear in the active tungsten or rhenium/tungsten alloy metal film when the latter is directly assembled on such a support. It also avoids having to insert between this metal film and the support any intermediate film designed to resolve the problems posed by the migration of carbon atoms in the metal film.

Accordingly, it becomes possible to make the anticathode rotate at an extremely high speed possibly reaching or even exceeding 20,000 rpm, whilst at the same time simplying its production and thus reducing costs.

Thermal modellings have therefore shown that at an equivalent diameter, anticathodes embodied in accordance with the invention may receive powers clearly greater than those acceptable for graphite support anticathodes embodied according to the currently used technique.

What is claimed is:

1. Rotating X-ray tube anticathode including a support coated with at least partly a refractory metal film in which the refractory metal film is in direct contact with the support made of a composite material formed of ceramic fibers embedded in a ceramic matrix, this material having a coefficient of expansion close to that of the refractory metal.

2. Anticathode according to claim 1, wherein the support is made of a composite material selected from the group including: Sic fibers/Sic matrix; Sic fibers/$Si_3N_4$ matrix; C fibers/SiC matrix; C fibers/$B_4$ C matrix; C fibers/$Si_3N_4$ matrix; Sic fibers/$B_4$ C matrix; and Ti $B_2$ fibers/Ti $B_2$ matrix.

3. Anticathode according to claim 2, wherein the support is made of a composite material formed of SiC fibers embedded in a SiC matrix.

4. Anticathode according to claim 1, wherein the refractory metal is selected from the group including tungsten and rhenium/tungsten alloys.

5. Anticathode according to claim 1, wherein the composite material includes woven fibers, the density of the fibers in the material being greater than 40% and the total porosity of the material being less than 20%.

* * * * *